US007381121B2

(12) United States Patent
Song et al.

(10) Patent No.: US 7,381,121 B2
(45) Date of Patent: Jun. 3, 2008

(54) BASE PAD POLISHING PAD AND MULTI-LAYER PAD COMPRISING THE SAME

(75) Inventors: Eu-Gene Song, Choongchungbook-do (KR); Ju-Yeol Lee, Kyungki-do (KR); Sung-Min Kim, Choongchungbook-do (KR); Jae-Seok Kim, Choongchungbook-do (KR); Hyun-Woo Lee, Choongchungbook-do (KR)

(73) Assignee: SKC Co., Ltd., Kyungki-do (KR)

( * ) Notice: Subject to any disclaimer, the term of this patent is extended or adjusted under 35 U.S.C. 154(b) by 0 days.

(21) Appl. No.: 10/580,617

(22) PCT Filed: Feb. 16, 2005

(86) PCT No.: PCT/KR2005/000441

§ 371 (c)(1),
(2), (4) Date: May 17, 2007

(87) PCT Pub. No.: WO2005/077602

PCT Pub. Date: Aug. 25, 2005

(65) Prior Publication Data

US 2007/0254564 A1 Nov. 1, 2007

(30) Foreign Application Priority Data

Feb. 17, 2004 (KR) ..... 10-2004-0010492
Mar. 11, 2004 (KR) ..... 10-2004-0016402

(51) Int. Cl.
*B24D 11/00* (2006.01)

(52) U.S. Cl. ..... 451/526; 451/533

(58) Field of Classification Search ..... 451/41, 451/285, 287, 526, 530, 533
See application file for complete search history.

(56) References Cited

U.S. PATENT DOCUMENTS

| | | | | |
|---|---|---|---|---|
| 6,319,108 | B1 | 11/2001 | Adefris et al. | |
| 6,679,769 | B2 | 1/2004 | Pinheiro et al. | |
| 2003/0181144 | A1* | 9/2003 | Mujumdar et al. | 451/41 |
| 2005/0221723 | A1* | 10/2005 | Duboust et al. | 451/41 |
| 2005/0255794 | A1* | 11/2005 | Vangsness et al. | 451/36 |
| 2006/0276109 | A1* | 12/2006 | Roy et al. | 451/41 |

FOREIGN PATENT DOCUMENTS

| | | |
|---|---|---|
| KR | 1020030066129 | 9/2003 |
| KR | 1020030011722 | 11/2003 |
| KR | 1020040060754 | 6/2004 |
| WO | WO 02/02274 | 10/2002 |

* cited by examiner

*Primary Examiner*—Eileen P. Morgan
(74) *Attorney, Agent, or Firm*—Abelman, Frayne & Schwab

(57) ABSTRACT

Disclosed is a base pad of polishing pad, which is used in conjunction with polishing slurry during a chemical-mechanical polishing or planarizing process, and a multilayer pad using the same. Since the base pad according to the present invention does not have fine pores, it is possible to prevent permeation of polishing slurry and water and to avoid non uniformity of physical properties. Thereby, it is possible to lengthen the lifetime of the polishing pad.

5 Claims, 3 Drawing Sheets

[Fig. 1]
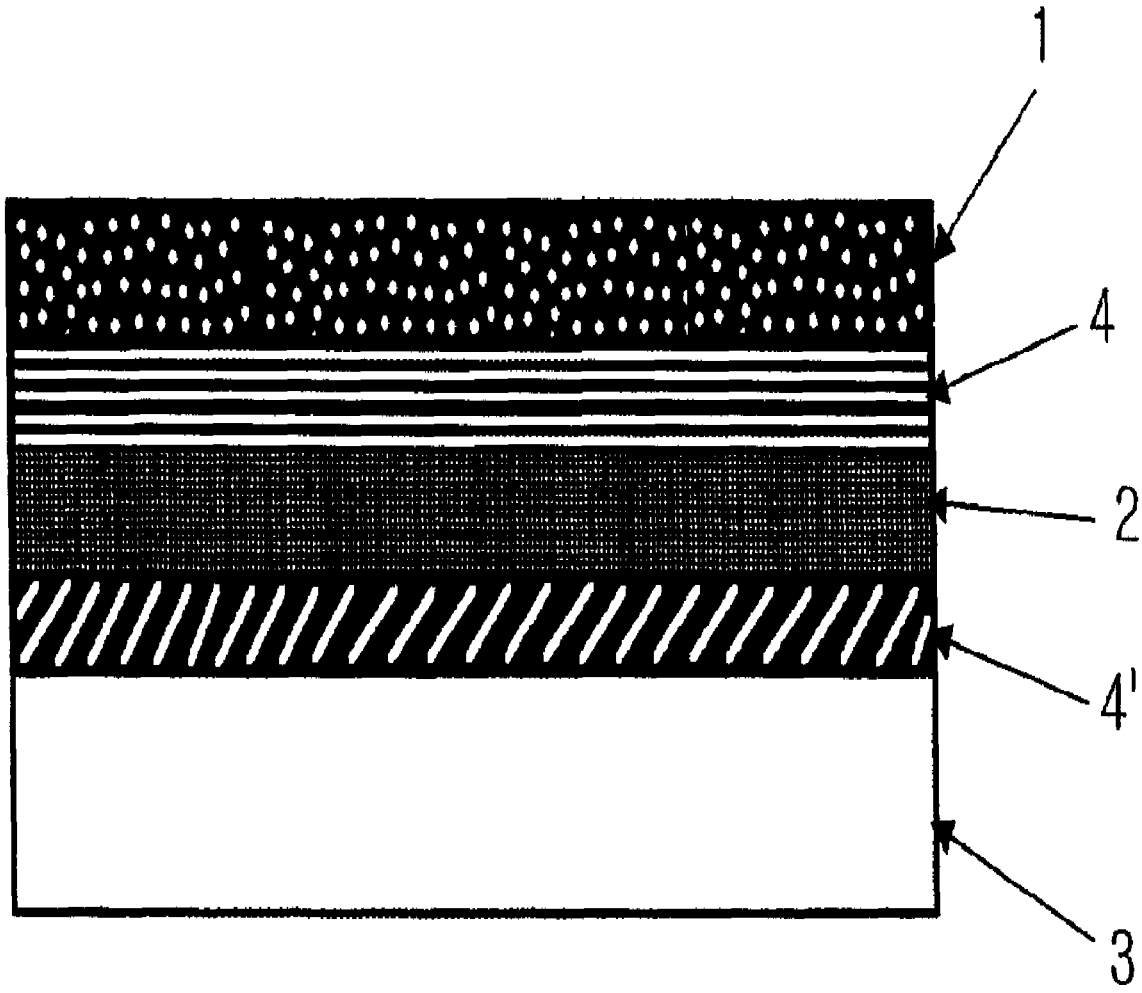

[Fig. 2]
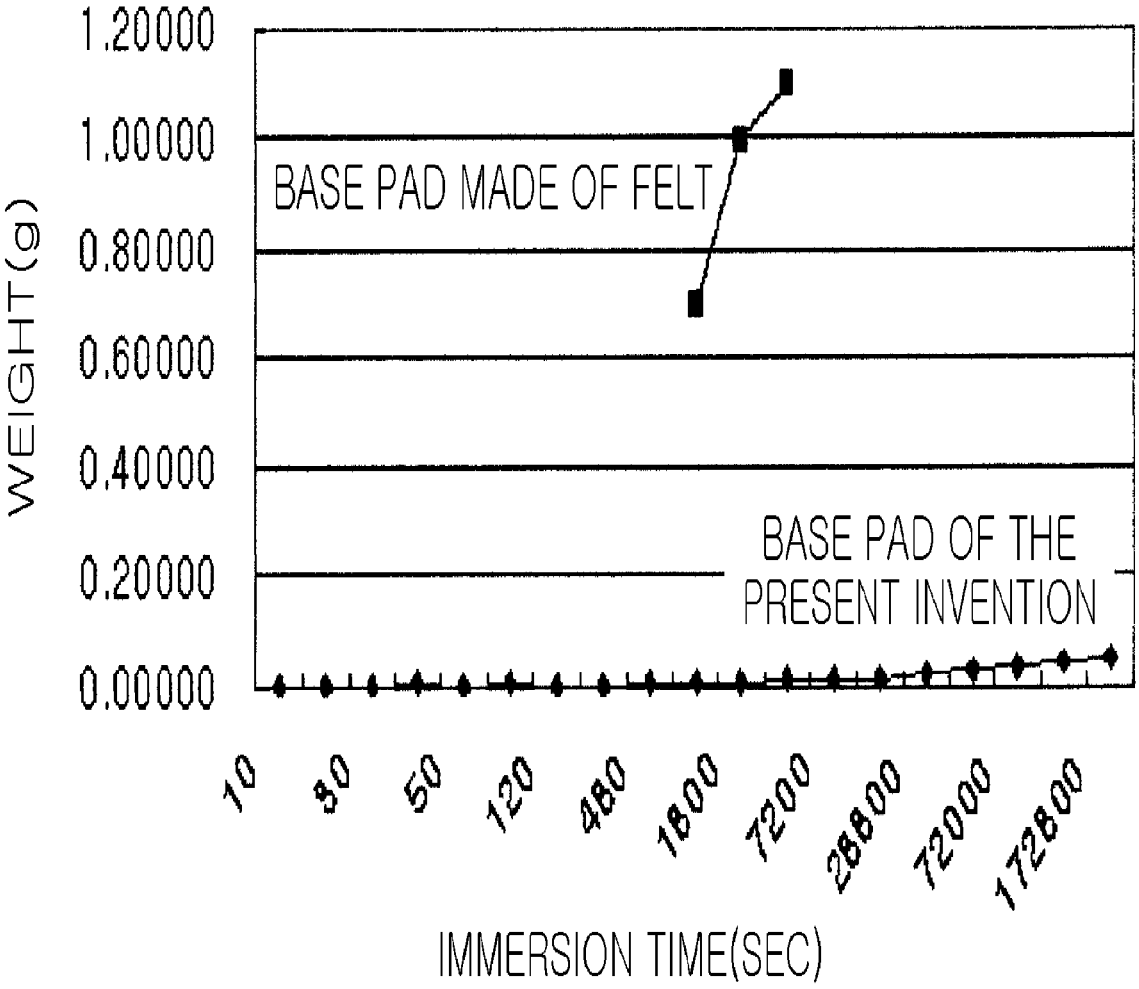

[Fig. 3]
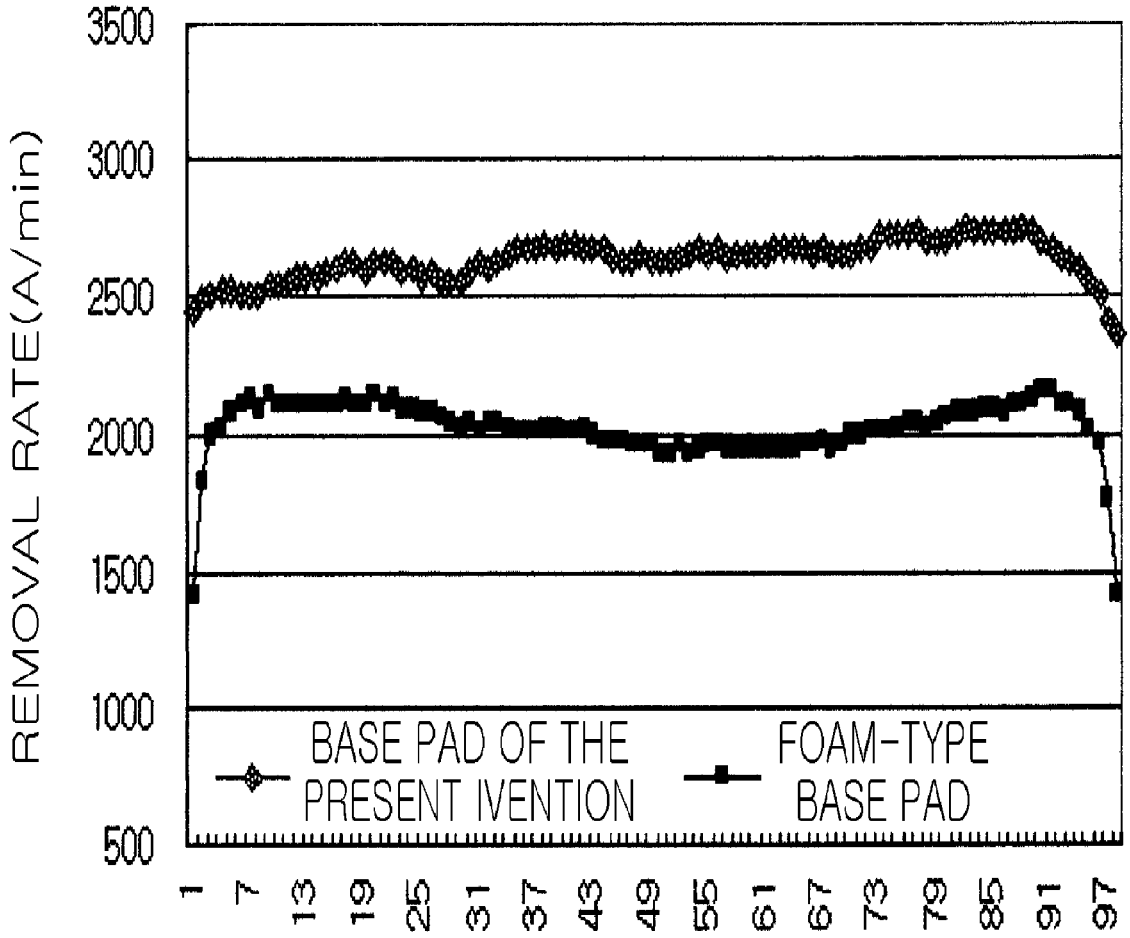

BASE PAD POLISHING PAD AND MULTI-LAYER PAD COMPRISING THE SAME

TECHNICAL FIELD

The present invention relates to a base pad of a polishing pad and a multilayer pad using the same. More particularly, the present invention pertains to a base pad of a polishing pad, which is used in a polishing process for planarizing various kinds of substrates in all stages of a semiconductor process, and a multilayer pad produced using the same.

BACKGROUND ART

A chemical mechanical polishing (hereinafter, referred to as "CAMP") or planarizing process is conducted to planarized various kinds of substrates, that is, substrates on which silicon, silicon oxide, metal (tungsten, copper, or titanium), metal oxide, dielectric, or ceramic is deposited, in all stages of a semiconductor process. This polishing process is one of precision/glossy surface grinding processes, in which polishing slurry is supplied between a polishing pad and a wafer to chemically corrode a surface of the wafer and to mechanically polish the corroded surface.

Typically, a polishing pad comprises a polishing pad which has a polishing layer for rubbing an object during a direct polishing process, and a base pad for supporting the polishing pad.

A method of producing the polishing pad is disclosed in, for example, Korean Patent Application Nods. 2001-46795, entitled "a method of producing a chemical mechanical polishing pad using a laser", 2002-45832, entitled "a method of producing a polishing pad using a laser beam and a mask", and 2002-06309, entitled "a composition for producing a polyurethane elastic body having high hardness and excellent wear resistance". Generally, micro-cells are formed, or a through hole or a groove is formed in the polishing pad through physical and chemical methods so as to preserve slurry for a long time. With respect to this, the above Korean Patent Application Nods. 2001-46795 and 2002-45832 disclose a method of forming various patterns of micro-holes, grooves and/or through holes on a polishing pad using a laser and a mask, which is adopted instead of a conventional method of forming cells by the insertion of a hollow body or chemical generation of foam, or instead of another conventional method of forming grooves and through holes using mechanical means. Furthermore, the above Korean Patent Application No. 2002-06309 suggests a composition for producing the polyurethane elastic body, which is capable of improving hardness and wear resistance of the polishing pad.

As well, the base pad is produced by incorporating sheet or felt, which is formed by foaming polyurethane material, into a polymeric substance. In more detail, the production of a polyurethane pad using typical foaming is achieved through a one-shot process consisting of one stage, in which all raw materials and foam bodies (chemical and mechanical foam) are agitated and reacted with each other at the same time, thereby forming fine pores in the pad. In the method of producing the pad through urethane incorporation, fibers, such as felt, are immersed in (whetted by) liquid polyurethane which is previously produced, thus polyurethane fills gaps between the felts, resulting in the formation of fine pores.

Polishing slurry and DAI water used during the polishing process may permeate into the fine pores existing in the base pad, and the permeation into the fine pores may negatively affect polishing uniformity of a wafer, which is an indicate of performance of the CAMP process. Additionally, the permeation reduces the time for which the polishing pad is used, that is, its lifetime. Furthermore, physical properties of the conventional base pad may be changed by a rotational force between a platen and a wafer and vertical stress during the CAMP process.

DISCLOSURE OF INVENTION

Technical Problem

Therefore, the present inventors have conducted extensive studies into the solution of problems occurring in the prior art, resulting in the development of a base pad of a polishing pad and a multilayer pad using the same. In the base pad, excellent polishing uniformity is assured without the permeation of polishing slurry and water during a chemical mechanical polishing or planarizing (CAMP) process, thus lengthening the lifetime of the polishing pad. An object of the present invention is to provide a uniform base pad having no internal fine pores, which is controlled in such a way that the fine pores do not exist therein, so as to prevent permeation of polishing slurry and water during a CAMP process and to prevent a change in physical properties thereof due to action of forces on a polishing pad during the CAMP process. Another object of the present invention is to provide a multilayer pad including the above base pad.

TECHNICAL SOLUTION

In order to accomplish the above objects, in the present invention, a base pad, which does not have pores but has uniform physical properties, is produced instead of producing a conventional base pad through foaming or the incorporation of felt.

BRIEF DESCRIPTION OF THE DRAWINGS

FIG. 1 illustrates a base pad of a polishing pad and a multilayer pad using the same according to the present invention;

FIG. 2 is a graph comparatively showing non-absorptivities when the base pad of the present invention and a conventional base pad made of felt are exposed to a mixture solution of water and polishing slurry (water:polishing slurry=1:1); and FIG. 3 is a graph comparatively showing the extent of planarization of substrates which are subjected to CAMP processes using the base pad of the present invention and a conventional foam-type base pad.

BEST MODE FOR CARRYING OUT THE INVENTION

In a conventional polymer base pad which is produced by foaming, or in a conventional base pad which is produced by incorporating felt into a polymeric substance, nonuniform pores exist due to characteristics of the production process. This causes absorption of polishing slurry or DAI water onto the base pad, and polishing slurry or DAI water absorbed onto the base pad causes non uniformity of a surface of the pad during a practical CAMP process. Accordingly, a wafer is nonuniformly polished during the CAMP process, which is undesirable in the CAMP process.

However, a base pad of the present invention, that is to say, the base pad having no pores therein, can assure uniform physical properties because the fine pores which may cause a nonuniform base pad are not formed in the base pad.

Since the conventional base pad, which is produced by the foaming or incorporation of felt into the polymeric substance, has fine pores, physical properties of the base pad are changed due to vertical stress and a rotational force between a platen and a wafer during the CAMP process, thus uniformity may be reduced during the polishing process.

Additionally, if polishing slurry and DAI water permeate into the pores of the base pad during the CAMP process, polishing uniformity of the wafer is reduced during the polishing process. The permeation of polishing slurry and DAI water into the base pad during the polishing process reduces the lifetime of a polishing pad.

Hence, in the present invention, the base pad having no fine pores is developed with the aim of preventing deformation of the base pad which may cause degraded physical properties during the polishing process.

In the present invention, the base pad does not have pores, thus it is possible to assure consistency of the thickness of the pad during high precision and high integration CAMP processes, thereby avoiding problems in highly precisely controlling the thickness of the conventional base pad using a mechanical process.

The base pad according to the present invention is made of at least one selected from the group consisting of polyurethane, PVC, polyvinyl alcohol, polyacrylic acid, polyacrylamide, polyethylene oxide, maleic acid copolymer, methylcellulose, and carboxymethylcellulose.

A method of producing the base pad according to the present invention employs a two-stage blend process so that the fine pores are not formed in the base pad, unlike the production of the conventional base pad using foaming or felt incorporation.

The two-stage blend process is called a pre-polymer process, and a process of producing a base pad having no fine pores. In other words, in order to produce the base pad having desired physical properties, at least one which is selected from the group consisting of polyurethane, PVC, polyvinyl alcohol, polyacrylic acid, polyacrylamide, polyethylene oxide, maleic acid copolymer, methylcellulose, and carboxymethylcellulose, is fed and reacted in a first reactor to firstly produce prepolymer. In a second stage, prepolymer is reacted with a substance having a polyol reaction group or an ammonia reaction group in a weight ratio of 3:1-2:1 so as to achieve complete hardening.

Examples of the substance having the polyol reaction group include polyester glycol, such as polyethylene adipate, polybutylene adipate, and polypropylene adipate, polyalkylene ether polyol, such as tetramethyl ether glycol, poly(oxypropylene)triol, poly(oxypropylene)poly(oxyethylene)triol, poly(oxypropylene)poly(oxyethylene)triol, and poly(oxypropylene)poly(oxyethylene)poly(oxypropylene) triol, polyester polyol, polybutadiene polyol, and polymer polyol. Furthermore, polyol is used alone or in a mixture.

Examples of the substance having the ammonia-based reaction group include 3,3'-dichlorobenzidine 4,4'-diamino-3,3'-dichlorophenylether, 4,4'-diamino-3,3'-dichlorodiphenylsulfide, 4,4'-diamino-3-chloro-3-bromodiphenylmethane, 4,4'-methylenebis(2-trifluoromethylaniline), 4,4'-methylenebis(2-chloroaniline) (commercial name—MOCA, manufactured by Dupon, Inc.), 4,4'-methylenebis(2-methoxycarbonylaniline), and 4,4'-methylenebis(2,5-dichloroaniline). As well, the substance having the ammonia-based reaction group is exemplified by a p- or m-phenylenediamine-based compound, such as 2,6-dichloro-m-phenylenediamine, 2-chloro-5-isobutoxycarbonyl-m-phenylenediamine, and 2-chloro-5-isopropoxycarbonyl-m-phenylenediamine, an aminobenzoate compound, such as trimethylenebis(p-aminobenzoate), and diethyleneglycolbis (p-aminobenzoate), and an aminophenylsulfide-based compound, such as 1,2-bis(p-aminophenylthio)ethane, and 1,2-bis(o-aminophenylthio)ethane. In addition, the substance having the ammonia-based reaction group is exemplified by 4-chloro-3,5-diamino-isopropylphenylacetate, 4-ethoxy-3,5-diaminotrifluoromethylbenzene, and bis-{2-(o-aminophenylthio)ethyl}terephthalate. Polyamine is used alone or in a mixture.

The base pad does not include fine pores, and has hardness of 10-100 Shore D and compressibility of 1-10%.

A conventional multilayer or two-layer polishing pad comprises a polishing pad having a hard polishing layer, and a soft base pad at a lower part thereof, thus a polishing speed is not so high during the polishing process. However, if the novel base pad as described above, that is, the base pad having no pores, is used to produce the two-layer or multilayer polishing pad as shown in FIG. 1, it is possible to increase the polishing speed of a wafer.

In the present invention, as shown in FIG. 1, a base pad 2 is attached to a polishing pad 1 having a polishing layer using a pressure sensitive adhesive (PSA) 4, thereby producing a two-layer polishing pad. Another base pad 2 may be attached to the two-layer polishing pad using the pressure sensitive adhesive 4 to produce the multilayer polishing pad. Furthermore, the multilayer polishing pad may be attached to a platen 3 in the polishing process using another pressure sensitive adhesive 4', which is used to conduct the polishing process. The pressure sensitive adhesive may be exemplified by an adhesive, including a polyacryl component, an epoxy component, or a rubber component, typically known in the art. A double-sided pressure sensitive adhesive tape in which a sticky and adhesive substance is applied on both sides of a base (PET film or felt) may be employed. In addition, the lamination of the multilayer pad may be implemented according to a typical method known in the art, for example, the lamination may be conducted through a conveyer method in which it passes between upper and lower rollers which are spaced apart by a predetermined interval.

The multilayer polishing pad, which includes the base pad having a thickness of 500-2500 micrometers, has a thickness of 2000-4000 micrometers.

Furthermore, the CAMP process is conducted using the polishing pad which includes the base pad having no fine pores according to the present invention, thereby increasing the polishing speed and preventing deformation of the base pad and reduced polishing uniformity due to permeation during the polishing process. Thus, it is possible to lengthen the lifetime of the polishing pad which includes the base pad having no fine pores.

FIG. 2 is a graph showing a weight as a function of an immersion time for a conventional base pad sample made of felt and a base pad sample according to the present invention. Weights of the conventional base pad and the base pad of the present invention are measured (using Mettler Toledo AX-204 as a laboratory electronic balance) before they are immersed in a mixture solution of polishing slurry and DAI water (1:1), and the samples are immersed for 10-172800 sec. The samples are taken out from the solution after different immersion times, air dried for 30 min, and weighed. It can be seen that the base pad of the present invention has a relatively constant weight according to the immersion time in comparison with the conventional pad in which felt is immersed in polyurethane, thus having non-absorptivity.

The CAMP process is conducted using a conventional foam-type base pad and the base pad of the present invention in IPEC 472, that is, a commercial CAMP process device, under conditions such that a flow rate of polishing slurry is 150 ml, a ratio of platen RPM:object head RPM is 46:28, and a ratio of head pressure:back pressure is 7:2.5. Planarization of a substrate is automatically measured using opti-probe which is thickness measuring equipment manufactured by Therma-wave, Inc. Thereby, a removal rate (polishing speed (A/min)) is obtained, and is shown in FIG. 3. From FIG. 3, it can be seen that the wafer polishing amount per unit time is more in the CAMP process using the base pad having no fine pores according to the present invention than in the CAMP process using the foam-type base pad. Particularly, in terms of the shape of an edge of the wafer, the base pad of the present invention is preferable to the conventional base pad.

When the base pad according to the present invention, that is, the multilayer polishing pad which includes the pad produced through a two-stage prepolymer process so that fine pores do not exist in the pad, is applied to the polishing process, the following advantages can be obtained.

1. It is possible to increase a polishing speed of a wafer during the polishing process, 2. Since deformation of the base pad due to vertical stress and rotational force caused by changes in CAMP devices and process variables during the polishing process is prevented, polishing uniformity of the wafer is not reduced, 3. Since permeation of polishing slurry or DAI water into the base pad does not occur, it is possible to maintain polishing uniformity of the wafer, 4. It is possible to prevent reduction of a lifetime of the polishing pad due to the deformation of the base pad and the permeation, 5. It is possible to assure uniform physical properties of the base pad, and to highly precisely control thickness and conduct a highly precise surface process in the course of processing the pad, thus it is useful in highly precise and integrated CAMP process, and 6. In the course of conducting a metal CAMP process, the base pad of the present invention has uniform surface and physical properties, thus dishing or erosion, which are caused by a difference between polishing speeds of silicon oxide and metal circuits, can be prevented.

INDUSTRIAL APPLICABILITY

A CAMP process is conducted using a polishing pad which includes a base pad having no fine pores according to the present invention, thus it is possible to increase a polishing speed and to prevent reduction of polishing uniformity due to deformation of the base pad and permeation occurring during the polishing process. Thereby, it is possible to increase the lifetime of the polishing pad that includes a base pad having no fine pores.

The invention claimed is:

1. A base pad of a chemical mechanical polishing pad, which does not include fine pores and has a hardness of 10-100 Shore D and compressibility of 1-10%, wherein the base pad is produced in such a manner that at least one compound is selected from the group consisting of polyurethane, PVC, polyvinyl alcohol, polyacrylic acid, polyacrylamide, polyethylene oxide, maleic acid copolymer, methylcellulose, and carboxymethylcellulose, is reacted in a first reactor to first produce a prepolymer, and the prepolymer is reacted with a substance having either a polyol reaction group in weight ratio of 3:1-2:1 or an ammonia reaction group in a weight ratio of 3:1-2:1 in a second step so as to achieve complete hardening.

2. The base pad as set forth in claim 1, wherein the base pad is 500-2500 micrometers in thickness.

3. A multilayer polishing pad which is produced using a base pad including no fine pores and having hardness of 10-100 Shore D and compressibility of 1-10%, wherein the base pad is produced in such a manner that at least one compound selected from the group consisting of polyurethane, PVC, polyvinyl alcohol, polyacrylic acid, polyacrylamide, polyethylene oxide, maleic acid copolymer, methylcellulose, and carboxymethylcellulose, is reacted in a first reactor to first produce a prepolymer, and the prepolymer is reacted with a substance having either a polyol reaction group in a weight ratio of 3:1-2:1 or an ammonia reaction group in a weight ratio of 3:1-2:1 in a second step so as to achieve complete hardening.

4. The multilayer polishing pad as set forth in claim 3, comprising a polishing pad having a polishing layer for polishing, and a base pad for supporting the polishing pad.

5. The multilayer polishing pad as set forth in claim 3, wherein the multilayer polishing pad has a thickness of 2000-4000 micrometers, in which the base pad has a thickness of 500-2500 micrometers.

* * * * *